United States Patent [19]

Bergner et al.

[11] 4,251,335

[45] Feb. 17, 1981

[54] PROCESS FOR THE DECHLORINATION AND COOLING OF THE ANOLYTE OF THE ALKALI METAL HALIDE ELECTROLYSIS

[75] Inventors: Dieter Bergner; Kurt Hannesen, both of Kelkheim; Wolfgang Müller, Bad Soden am Taunus; Wilfried Schulte, Hofheim am Taunus, all of Fed. Rep. of Germany

[73] Assignee: Hoechst Aktiengesellschaft, Frankfurt am Main, Fed. Rep. of Germany

[21] Appl. No.: 138,884

[22] Filed: Apr. 10, 1980

[30] Foreign Application Priority Data

Apr. 12, 1979 [DE] Fed. Rep. of Germany ..... 2914870

[51] Int. Cl.[3] ..... C25B 1/34

[52] U.S. Cl. ..... 204/98; 204/128

[58] Field of Search ..... 204/98, 128

[56] References Cited

U.S. PATENT DOCUMENTS 3,988,235 10/1926 Shibata et al. ..... 204/128

4,105,515 8/1978 Ogawa et al. ..... 204/98

4,176,023 11/1979 Childress ..... 204/128

*Primary Examiner*—R. L. Andrews

*Attorney, Agent, or Firm*—Curtis, Morris & Safford

[57] ABSTRACT

The electrolysis of aqueous alkali metal chloride solutions under pressure has already been carried out. In accordance with the invention there is applied a pressure of at least 8 bars in the anode space for such an electrolysis, as well as a special process for the work-up of the products of the anode space. The mixture of gas and anolyte leaving the anode space is at first mechanically separated, and the anolyte is then depressurized into a stripping column. In the course of this process a dechlorination and cooling of the anolyte are taking place. The anolyte is to enter the pressure release vessel (stripping column) with a temperature being above the boiling point of the anolyte at atmospheric pressure. The reduced pressure is to be between 2 bars and atmospheric pressure. By means of these measures it may be ensured that the anolyte in the stripping column reaches boiling point. Finally the chlorine set free in the pressure release operation is separated from the anolyte.

18 Claims, 4 Drawing Figures

Figure 1:
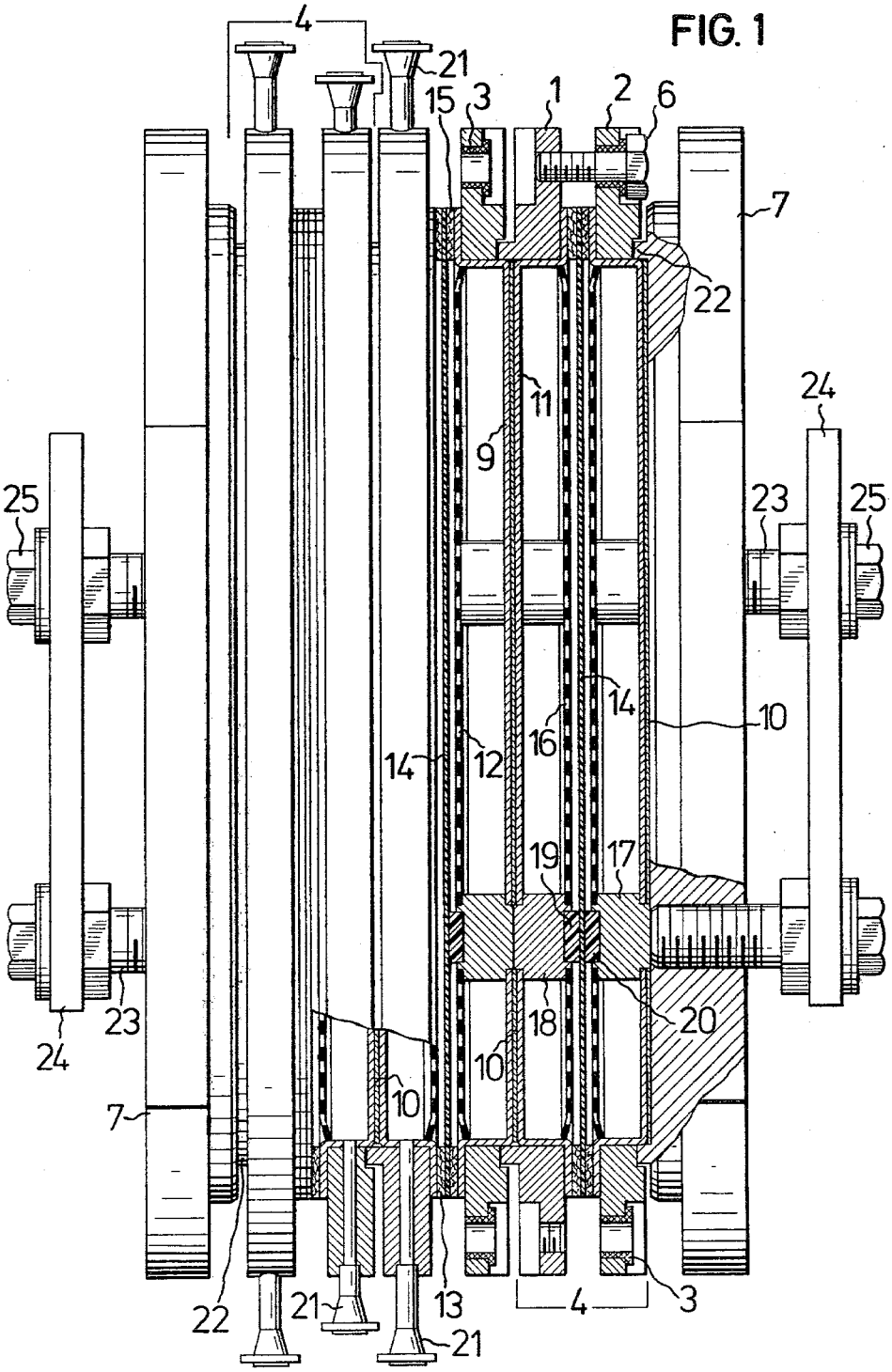
Figure 3:
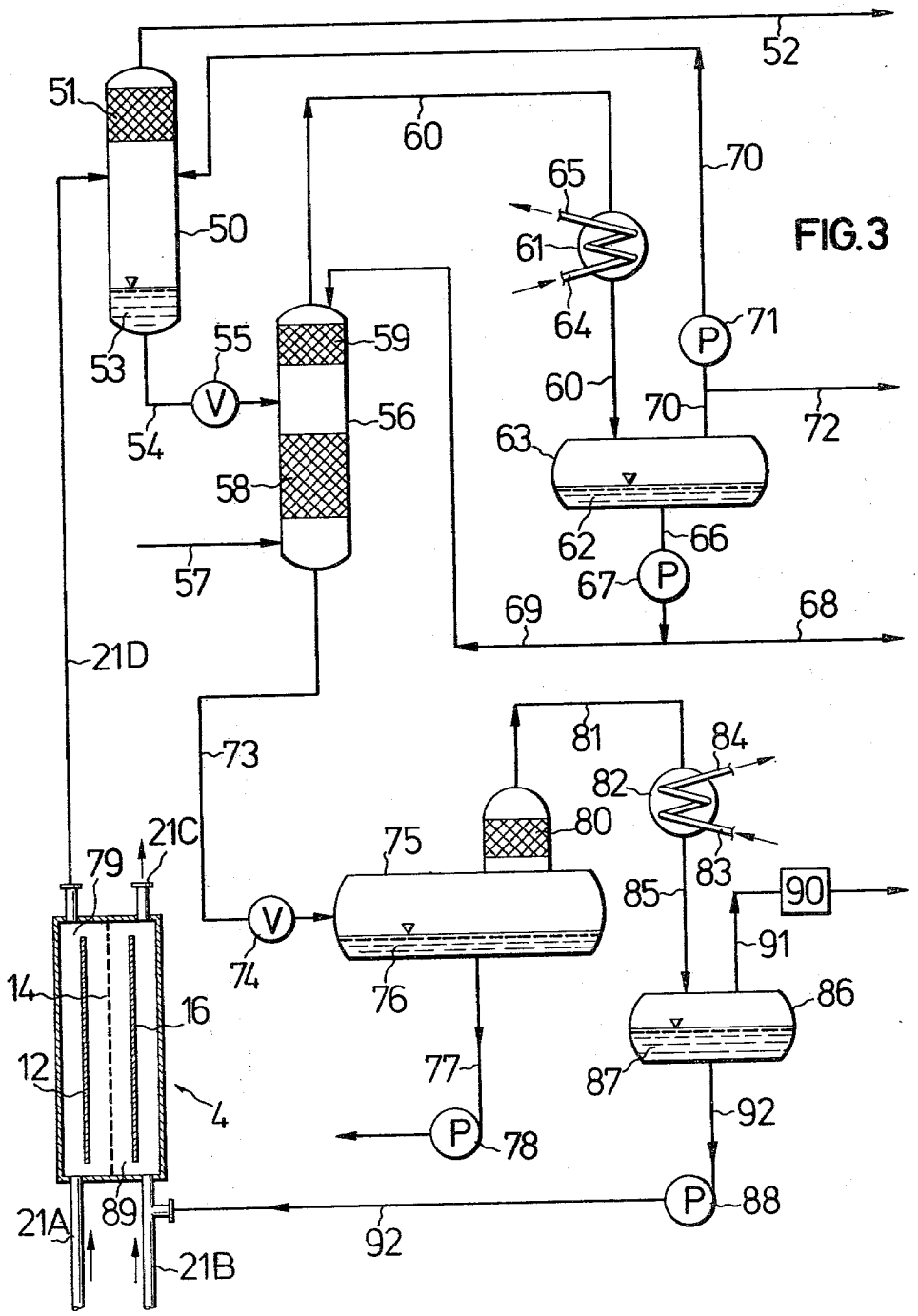

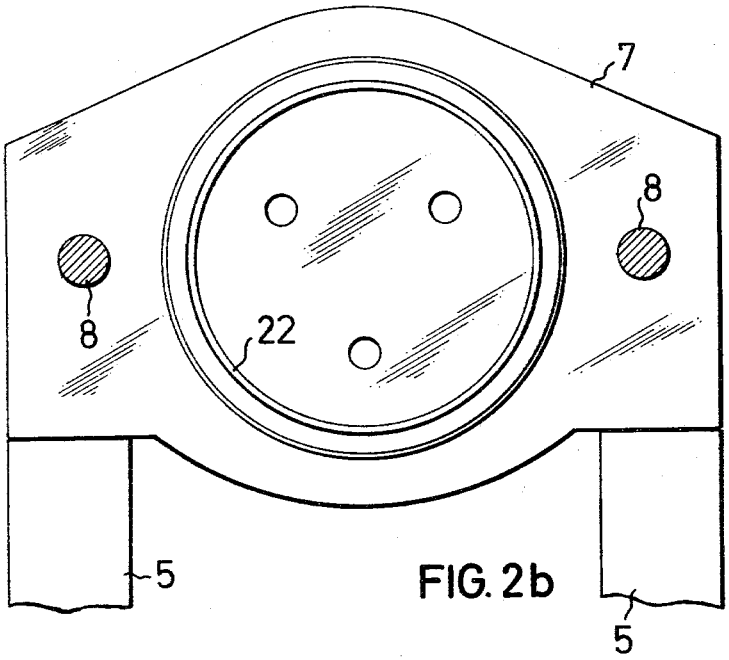
FIG. 2b
FIG. 2a
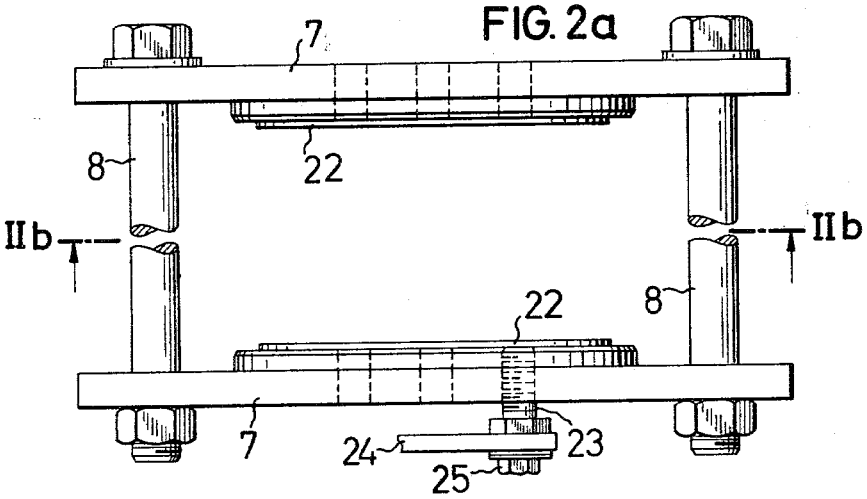

PROCESS FOR THE DECHLORINATION AND COOLING OF THE ANOLYTE OF THE ALKALI METAL HALIDE ELECTROLYSIS

The invention relates to a process for the extensive dechlorination of the anolyte of an alkali metal chloride electrolysis, which is obtained in a hot state and saturated with chlorine after the performance of a pressure electrolysis at more than 7 bars.

In the processes carried out in industry for the dechlorination of the anolyte of electrolytic cells operating under normal pressure, the anolyte is dechlorinated by releasing the pressure in a vessel maintained under vacuum. In the course of this spontaneous pressure release the dissolved chlorine is evaporated, so that a dechlorinated anolyte remains in the vacuum vessel. The chlorine-containing vapor being formed in the evaporation process is cooled, the resulting chlorine-containing condensate is pumped back into the anolyte, and the vapor proportion not having been condensed during cooling, which consists substantially of chlorine and steam, is brought back to normal pressure and then dried. However, a complete dechlorination of the anolyte is only ensured, if at a given temperature of the anolyte the vacuum is chosen such that upon releasing the pressure the anolyte is brought to the boil. Yet in practice the pressure release is frequently effected into a simple vessel, so that due to the mixing effect there is no complete dechlorination. The residual dechlorination is then carried out by blowing off the remaining chlorine with air, cooling the air charged with chlorine and steam and feeding it by way of a blast apparatus into the chlorine destruction device.

The drawbacks of these electrolysis processes carried out in may variants under normal pressure are evident: Since with a rise in temperature in an amount of steam increasing at a superproportional rate is discharged from the cells together with the chlorine, which steam must subsequently be removed from the chlorine current by cooling and drying, the anolyte temperature is limited to a maximum of about 85° C. If a lower temperture is present, the anolyte must be depressurized into a correspondingly higher vacuum, in order to reach the boiling point. However, this leads to an increased volume of the vapor, which requires larger apparatus and conduction profiles. More particularly, it is necessary to design the chlorine compressor for a large aspirated volume and for a higher output. It is to be considered, however, that those parts of the apparatus which come into contact with moist chlorine have to be manufactured from expensive special material due to the risk of corrosion. Besides, there is an increasing energy expenditure in the electrolytic cell with decreasing anolyte temperature.

The above mentioned residual dechlorination of the anolyte by blowing in air has the drawback that the air charged with chlorine has to be dechlorinated in the chlorine destruction device, which inevitably results in a high yield of undesired hypochlorite.

The production of chlorine- and salt-free condensate is only possible to a limited degree in electrolyses carried out under normal pressure, since with the conventional vacuum devices available the anolyte temperature is but little reduced by the pressure release. A larger part of the heat capacity of the anolyte can only be used for the evaporation of water, if the vacuum applied is considerably improved. However, this involves a higher technical expenditure for the vacuum adjustment on the one hand and on the other hand leads to an increase of the vapor volume. Besides, the condensate from the vapor contains chlorine and would have to be dechlorinated for further use, by means of a second pressure release after heating or by way of stripping. Yet this involves an inadequately high expenditure.

Some of these drawbacks may be avoided by carrying out the electrolysis under pressure, as higher anolyte temperatures can be reached in this manner. Thus it has already been described in German Offenlegungsschrift No. 2,729,589 to execute the electrolysis at a pressure of from 1 to 5 atmospheres while using a cation exchange membrane. The advantages are reported to reside in the fact that the cell voltage may be reduced and the cell temperature may be raised without increasing the cell voltage. Furthermore, if a cation exchange membrane is used, the electrolysis may be carried out with a high current density without damaging the membrane. Besides, the drying energy required for compression for the liquefaction of the chlorine may be reduced or saved completely. The Joulean heat of the anolyte generated in the electrolytic cell may be used as a source of heat for the concentration of the alkali metal hydroxide.

However, in German Offenlegungsschrift No. 2,729,589 a warning has been given not to apply a pressure of 7 bars or more, a otherwise there is a risk of the cation exchange membrane no longer sustaining the higher operating pressure. According to the specifications given in the cited Patent Application the cooling of the hot chlorine produced is effected by a direct heat exchange with cold alkali metal chloride solution and cold water. The dissolved chlorine has finally to be separated from the water by a vacuum treatment. Since the working pressure of the electrolysis is below the liquefying pressure of chlorine at room temperature, a liquefaction is only possible with the aid of a compressor or by using refrigerating aggregates.

Therefore, it has been the object of the present invention to provide an economical process for the work-up of the products being formed in the anode space of an alkali metal chloride electrolytic cell. In said process the electric heat generated was to be used in a suitable manner as far as possible, and the liquefaction of the chlorine was to be effected in a particularly easy manner.

There has now been found a process for the dechlorination and cooling of the anolyte of an alkali metal chloride electrolytic cell by a decrease of pressure, which comprises effecting the electrolysis under a pressure of at least 8 bars in the anode space, separating the products leaving the anode space (anolyte and resulting gases) mechanically by means of a separator, depressurizing the separated anolyte with a temperature above the boiling temperature at atmospheric pressure in a stripping column to a pressure between atmospheric pressure and 2 bars, with the proviso that under these conditions the anolyte is brought to the boil, and separating subsequently the anolyte freed from chlorine by the pressure release from the gaseous phase having been formed in the stripping column.

Preference is given to a pressure in the anode space of from 8 to 20 bars, especially from 8 to 12 bars. At a pressure of more than about 50 bars there is a strong increase of the investment and operating expenses.

The boiling temperature of the anolyte in the pressure release naturally depends somewhat on the actual barometric pressure ("atmospheric pressure"). In view of the low salt concentrations of the exhausted anolyte which normally occur in the alkali metal chloride electrolysis, a temperature of this spent anolyte when being fed into the stripping column of at least 103° C., preferably at least 105° C., especially at least 110° C., is generally sufficient, in order to bring the anolyte to the boil by way of pressure release. The feeding temperature is preferably 140° C. at a maximum, especially 130° C. at a maximum.

In the course of the pressure release the dissolved chlorine as well as water are evaporated. At the same time the anolyte is cooled.

As far as there are used membrane cells for the alkali metal chloride electrolysis, the problem mentioned in German Offenlegungsschrift No. 2,729,589 with regard to the mechanical stability of the cation exchange membrane can also be solved for a working pressure of more than 8 bars. For example, the membrane may be pressed directly on either electrode, preferably the anode. The electrode is in this case advantageously of a perforated design, for example it is manufactured from expanded metal. In this manner it can be ensured that the membrane is supported by the electrode surface, yet the circulation of the electrolyte still being sufficient.

By means of an automatic pressure regulation known per se it can also be ensured that the pressure difference between the cathode space and the anode space does not exceed a determined value and that optionally additional valves are opened for the discharge of chlorine or the anolyte or of hydrogen or the catholyte.

Said pressure difference should be at most 5 bars, better at most 3 bars, even better at most 1 bar, still better at most 0.5 bar, and preferably 0.1 bar at a maximum. However, the pressure difference should be at least 5 mbars, preferably at least 10 mbars, so that the membrane is pressed on the electrode.

For the manufacture of an electrolytic cell operating at a pressure of more than 8 bars there may be used the same materials which are employed for the construction of normal pressure electrolytic cells, for example titanium for the inner surface of the anode space and steel for the inner surface of the cathode space.

A pressure electrolytic cell which is particularly appropriate for a working pressure of at least 8 bars has been the subject of a copending application of the applicants ("electrolytic apparatus") with the same priority date (Serial No. . . . ). It is briefly described in Example 2 (with pertinent FIGS. 1 and 2*a*, 2*b*.

It is not absolutely necessary to feed the total amount of anolyte freed from chlorine in the separator into the stripping column. It is also possible to pump part of the brine dechlorinated in the separator directly or via a cooler back into the anode space, for example in order to increase the internal brine circulation and to improve the heat transport from the cells.

The stripping column is generally designed as a vertical cylindrical vessel which may contain various built-in elements (for example plates or packed beds). Yet the stripping column may also be designed as a horizontal vessel as well. The only requirement is to be seen in that there must not be any back-mixing of the fed-in brine and the discharged brine and that the evaporating surface for the brine is sufficiently large. The evaporating surface and the dwelling time of the brine in the stripping column must be of such order that the main amount of the chlorine is removed in the column. It is advantageous, but not necessary, to provide a mist collector at the column head in order to retain liquid constituents that have been entrained.

If the temperature with which the anolyte leaves the anode space is below boiling point at atmospheric pressure, the anolyte is to be heated before being fed into the stripping column.

In order to support the dechlorination process, steam may additionally be blown from below into the stripping column. For this purpose, built-in elements (for example plates or packed beds) are advantageous to improve the gas exchange between the boiling anolyte and the steam.

In principle it is also possible to operate the stripping column at low pressure, for example in cases where the temperature of the anolyte to be dechlorinated is below its boiling point at atmospheric pressure. However, the technical expenditure for producing the vacuum and for treating the large gas volumes formed is considerable.

This is why it is recommended to carry out the electrolysis in a manner that the anolyte leaving the anode space already shows a temperature which is above boiling point atmospheric pressure. The temperature of the anolyte in the cell is preferably at least 90° C., advantageously from 105° to 140° C., especially from 110° to 130° C.

In the stripping column a working pressure of 1.5 bars at a maximum, especially 1.1 bars at a maximum, is preferred.

When the anolyte is boiling in the stripping column, a gas is being formed which consists mainly of chlorine and steam. To facilitate the further work-up of this gas current, it is advantageous to condense the main amount of water by cooling. In the course of this process there is formed a chlorine-containing condensate which may be pumped back into the anode space of the electrolytic cell, for example by mixing it with the feed brine. The steam is advantageously condensed at cold surface, i.e. by indirect cooling.

The further work-up is preferably carried out by introducing an aqueous liquid such as brine which is cold (i.e. of a temperature lower than that corresponding to the gaseous phase) into the head of the stripping column and thus removing the main portion of the remaining steam from the gaseous phase.

As cooling medium, use may be made for example of cold catholyte being under reduced pressure, which can be obtained from hot catholyte by pressure release and subsequent vacuum treatment. While the steam is thus partially condensed and the chlorine is cooled, the catholyte is brought to the boil. In this manner the condensation heat of the steam may be used for evaporating the catholyte.

The chlorine-containing condensate obtained may be used, for example, to irrigate the built-in elements of the stripping column (packed beds, plates) from above, thus keeping them in a moist state. In this manner the salt mist formed in the pressure release of the hot anolyte is retained more easily.

However, it is also possible to remove the main amount of chlorine from the condensate by blowing in inert gases, for example air. Yet due to the small amounts of condensate and the additional apparatuses required, this variant is not advantageous in the case of small units.

The portions which have not been liquefied in the condensation (chlorine, steam) may be compressed and for example be recirculated into the separator.

The gaseous phase having been formed in the stripping column does not have to be freed from the main amount of water by condensation. Said phase may also be charged directly into a neutralization column in which hypochlorite is produced, or may be fed into a chlorine destruction installation, for example in smaller units.

The anolyte having been freed largely from a chlorine in the stripping column may be introduced into a vacuum container in which it is depressurized. The vapors obtained in this process can be condensed by further cooling. A cooling results already from the pressure release of the anolyte in the vacuum container. The degree of cooling depends on the vacuum level.

The vacuum container may be of a horizontal or vertical design. A sufficiently large evaporating surface is essential. In addition a back-mixing between the warm brine freshly introduced and the cooled brine is to be avoided.

The condensate being free from chlorine and salt and resuting from the condensation of the vapors of the vacuum container may be used for many purposes. If the alkali metal chloride electrolysis is operated according to the membrane cell process, it is advantageous to add the chlorine- and salt-free condensate to the catholyte of the membrane cell, for example to introduce it directly into the cathode space. The condensate may as well be used for preparing brine in the salt dissolving vessel. In either case the amount of soft water to be provided otherwise is reduced.

Where there is no need to extract the condensate being free from chlorine and salt, i.e. if a sufficiently large amount of salt-free water is available, the second pressure release in the vacuum container is no longer necessary.

The latent heat of evaporation generated in the condensation of the vapors formed in the pressure release process in the vacuum container may also be used for evaporating the catholyte.

It has been found that by using the features of the present invention, especially by increasing the anolyte temperature in the cell, a chlorine current which is easily liquefied is obtained in a very economical manner, i.e. with a very low expenditure of electrical and thermal energy. Said liquefaction is achieved without a compression step, but merely by water cooling, and without using any additional cooling. Since liquefied chlorine contains only a very small amount of dissolved water at room temperture, it may be dried without high expenditure. Thus, the process of the invention proves to be especially advantageous with regard to a membrane cell electrolysis.

When starting the cell operation, the anolyte leaving the cell with a pressure of at least 8 bars will not yet have generally reached the boiling temperature at atmospheric pressure. In this case the anolyte may be heated, for example in a heat exchanger, or the pressure release of the anolyte in the stripping column may be supported by adding steam. Thus, this process for the dechlorination of the anolyte of the alkali metal chloride electrolysis by pressure reduction comprises effecting the electrolysis under a pressure of at least 8 bars in the anode space, separating the products leaving the anode space of the electrolytic cell (anolyte and resulting gases) mechanically in a separator, depressurizing the separated anolyte which has a temperature below the boiling temperature of the anolyte at atmospheric pressure in a stripping column to a pressure between atmospheric pressure and 2 bars, treating the anolyte in the stripping column in the countercurrent with steam until it reaches the boiling point, and separating the anolyte freed from chlorine by way of the pressure release and the steam treatment from the gaseous phase having been formed. The introduction of steam into the stripping column involves a certain dilution of the anolyte. However, this measure may be desirable, as water is extracted from the anolyte in a membrane electrolytic cell.

A special embodiment of the process in the invention may be seen from the flow chart shown in FIG. (3). The combination of apparatuses indicated therein is only exemplary, so that a different conection of units and a different design of apparatuses is well possible in any individual case, depending on the given circumstances.

The device of the invention is shown diagrammatically by way of example in the accompanying drawings.

The pressure electrolysis cell (4) is devided into the anode space (79) with the anode (12) and the cathode space (89) with the cathode (16) by means of a membrane (14). Concentrated brine is introduced under pressure into the anode space (79) through inlet (21 A). A mixture of $H_2$ and the catholyte is discharged from the cathode space (89) through outlet (21 C).

The mixture of exhausted brine, chlorine and steam being discharged from the anode space (79) and having a temperature of for example 110° C. is introduced via conduit (21 D) into separator (50) with the mist collector layer (51), where the liquid portions are separated from the vaporous portions. The chlorine-steam mixture which still contains a small amount of oxygen and inert gases is passed through the mist collector layer (51) and is then passed on via conduit (52) under electrolytic pressure for further work-up, for example for drying and liquefaction. The depressurized anolyte (53) obtained in separator (50), which has been saturated with chlorine in conformity with the pressure and temperature, is discharged from said separator (50) and depressurized via conduit (54) and the pressure release valve (55) in the stripping column (56) to a lower pressure (in this case atmospheric pressure). In the course of this process the anolyte reaches the boiling point. It is thus completely dechlorinated in the stripping column.

The stripping of the chlorine in column (56) may be supported by steam being introduced via inlet tube (57). The packing layer (58) ensures a particularly good contact between the pressurized anolyte and the steam. As has been indicated above, this addition of steam is especially useful in cases where the anolyte temperature has not yet reached the boiling point at the time of the start of the operation. The upper packing layer (59) frees the chlorine/steam mixture from brine drops. Said mixture leaves column (56) via outlet (60). In condenser (61) part of the steam is condensed, and the condensate (62) is collected in the collecting vessel (63). Through inlet (64) there is introduced a cooling medium (for example cooling water or a catholyte having been depressurized or further cooled by vacuum evaporation), which leaves the condenser in a heated state via outlet (65).

This chlorine-containing condensate is recirculated into the electrolysis via conduit (66), pump (67) and conduit (68). A part of the condensate may be optionally introduced via conduit (69) into the stripping column (56). By this means it can be ensured that the packing layer (59) of the stripping column remains in a moist state, the retention of the brine drops thus being improved.

The chlorine/steam mixture not having been condensed in vessel (63) is passed via conduit (70), in which compressor (71) has been intercalated, into separator (50). Other portions may be passed on via conduit (72) for the preparation of hypochlorite or introduced into a liquefying unit for chlorine.

The brine having been completely dechlorinated in stripping column (56) is discharged via conduit (73) and depressurized via pressure release valve (74) into vacuum vessel (75). The level of the vacuum in vessel (75) depends on the temperature with which the brine concentrated therein (76) is to leave vessel (75) or on the desired amount of chlorine- and salt-free condenate to be obtained in the concentration of the brine. The brine cooled in vessel (75) leaves the same via outlet (77). It is pumped back by means of pump (78) into the salt dissolving vessel and the brine purification unit (not shown) and finally into the anode space (79). The steam developed in vessel (75) is freed in the mist collector layer (80) from entrained brine drops and is then passed via conduit (81) into the condenser (82), where it is condensed. The condenser (82) may be supplied via inlet (83) with cooling water which leaves the condenser in a heated state via conduit (84); however, it is also possible to utilize at least part of the large amount of heat obtained for the catholyte evaporation, i.e. to use lye as cooling agent for the cooling in condenser (82). The condensate produced in condenser (82) is passed via conduit (85) into condensate vessel (86), where it is collected. Via conduit (92), in which pump (88) has been intercalated, the condensate (87) may be passed to feed tube (21 B), through which circulating catholyte is recirculated into the cathode space (89). In this manner the concentration of the catholyte may be kept constant. The condensate (87) may likewise be introduced into the salt dissolving vessel (not shown). By means of the vacuum pump (90) which is connected via conduit (91) with the condensate vessel (86), the vacuum in the condensate vessel (86) and in vessel (75) is maintained.

The following Examples illustrate the invention.

EXAMPLE 1

With a chosen cell pressure of 10 bars, a cell temperature of 115° C., an intended chlorine production of 170,000 tons per year, and an assumed exhaustion of the brine from 260 kg to 220 kg of NaCl per ton of brine there is calculated a brine circulation of 825 tons per hour, a chlorine production of 20 tons per hour and a salt consumption of 33 tons of NaCl per hour. In the anolyte leaving the separator with cell temperature, from 1.2 to 1.6 tons of chlorine per hour are dissolved; this corresponds to about 6 to 8% of the amount of chlorine produced. After the condensation of the vapors from the stripping column, the above-mentioned 1.2 to 1.6 tons of chlorine per hour remain in the gaseous phase, together with about 0.035 ton of steam per hour. The condensate of the vapors of the stripping column (for example 0.5 ton per hour) contains only a small amount of dissolved chlorine and may be pumped into the salt dissolving vessel. The brine itself leaves the stripping column with boiling temperture, i.e. with about 107° C. If during the pressure release of the stripping column into the vacuum vessel a pressure of 400 mbars is maintained, the dechlorinated brine is cooled to about 83° C. by evaporation. In the course of this process 29 tons of steam per hour are set free; on the other hand, if the pressure in the vacuum vessel is only 520 mbars, the brine is only cooled to 90° C. and 20 tons of steam per hour are evaporated. The amount of heat generated in the condensation of the vapors is sufficient to evaporate the cell lye for example from 25% by weight to 50% by weight. So far the use of steam from other sources may be dispensed with for concentration.

EXAMPLE 2

The electrolytic apparatus for the preparation of chlorine from aqueous alkali metal chloride solution, which is resistant to a pressure of more than 10 bars, comprises at least one electrolytic cell the anode and cathode of which, separated by a separating wall, are arranged in a housing of two hemispherical shells; the housing being provided with equipment for the feed of the starting materials for electrolysis and the discharge of the electrolysis products, and the separating wall being clamped by means of sealing elements between the rims of the hemispherical shells and positioned between power transmission elements of non-conductive material extending each to the electrodes. In said electrolytic apparatus the electrodes are connected mechanically and electrically (conductively) with the hemispherical shells via the rim and via spacers fixed to the shells having a substantially circular cross-section; the hemispherical shells of adjacent cells support and contact each other flatwise, and the end positioned shells of the electrolytic apparatus are supported by pressure compensation elements.

FIG. 1 is a partially cross-sectional view of the electrolytic apparatus;

FIG. 2*a* is a top view of the presure compensation elements of the electrolytic apparatus; and FIG. 2*b* shows section II*b*—II*b* of FIG. 2*a*.

The electrolytic apparatus has at least one individual electrolytic cell 4. Each individual electrolytic cell consists substantially of the two flange parts 1 and 2, which are fastened one with the other by means of screws 6, and between which the membrane 14 is tightly sealed. Flange parts 1 and 2 are electrically insulated with respect to each other, for example by means of insulating bushes 3. The hemispherical shells 9 and 11 are slid into flanges 1 and 2, where they form an inner lining, the rims of which protrude over the sealing surfaces of flanges 1 and 2. The sealing rings 13 and 15 ensure tight sealing against the membrane 14. The anode 12 and the cathode 16 are fastened to the hemispherical shells 9 and 11. The bottoms of shells 9 and 11 of adjacent cells are pressed one onto the other under the internal cell pressure; they may be separated by a sheet 10 (plastic material or metal). Concentrically arranged beads in the hemispherical shells 9 and 11 cause a membrane-type behavior (not shown). The spacers 17 and 18 (conductive bolts) used for current supply and power transmission are provided on their face in the interior of the cell with power transmission elements 19 and 20, for example disks of insulating material, between which the membrane 14 is clamped. The anode 12 and the cathode 16 are fastened to the spacers 17 and 18, respectively. Feed and discharge of anolyte and catholyte are ensured via ducts 21 which are passed radially through flanges 1 and 2.

The end positioned hemispherical shells of the electrolytic apparatus are supported by pressure compensation elements, which consist of the two plates 7 and the tie rods 8. Alternatively, the plates 7 may be connected with hydraulic means (not shown) instead of the tie rods. The hemispherical shell 9 or 11 of end positioned cell 4 is in each case supported against the internal cell pressure by means of plate 7 which optionally catches in flange 2 or 1 by means of a spring 22. The two end plates 7 are drawn together by means of the tie rods 8, so that the liquid pressure on the shells is compensated via the tie rods, which are positioned on base elements 5. The plates 7 are provided with the threaded bolts 23 which, on tightening, press on the spacers 17 and 18. The threaded bolts 23 are connected with the current supply means 24 by corresponding devices 25. The feed wires (not shown) are connected with these current supply means 24. Before starting operations of the electrolytic apparatus, the individual electrolytic cells 4 are pressed one to the other by means of the pressure compensation elements, and the threaded bolts 23 are tightened, so that the electric contact is ensured via the spacers 17 and 18 in such a manner that it passes through all cells. The individual cells have a substantially circular cross-section; that is, the cross-section on the electrode level is circular, elliptic, oval or the like.

What is claimed is:

1. Process for the dechlorination and cooling of the anolyte of an alkali metal chloride electrolysis by pressure release, which comprises effecting the electrolysis under a pressure of at least 8 bars in the anode space, separating the products leaving the anode space of the electrolytic cell (anolyte and resulting gases) mechanically by means of a separator, depressurizing the separated anolyte with a temperature above the boiling point of the anolyte at atmospheric pressure into a stripping column to a pressure between atmospheric pressure and 2 bars, with the proviso that under these conditions the anolyte is brought to the boil, and separating subsequently the anolyte freed from chlorine by said pressure release from the gaseous phase having been formed in the stripping column.

2. Process as claimed in claim 1, wherein the stripping column contains built-in elements of a large surface.

3. Process as claimed in claim 1, which comprises further depressurizing the brine into a vacuum vessel, after it has left the stripping column, and condensing the resulting vapors by cooling.

4. Process as claimed in claim 1, which comprises effecting the electrolysis at a pressure of from 8 to 20 bars.

5. Process as claimed in claim 1, which comprises reducing the pressure in the stripping column to a maximum of 1.5, preferably a maximum of 1.1 bars.

6. Process as claimed in claim 1, which comprises blowing steam into the stripping column from below, in order to facilitate the dechlorination of the anolyte.

7. Process as claimed in claim 1, which comprises effecting the electrolysis in a way that the anolyte reaches a temperature of at least 90° C.

8. Process as claimed in claim 7, wherein the temperature of the anolyte is in the range of from 105° to 140° C., preferably from 110° to 130° C.

9. Process as claimed in claim 1, which comprises condensing the main amount of water by cooling from the gaseous phase having been formed in the stripping column.

10. Process as claimed in claim 9, which comprises compressing the gaseous phase not having condensed when cooling with water and consisting essentially of chlorine and steam, and recirculating said phase into the separator.

11. Process as claimed in claim 9, which comprises irrigating the stripping column with part of the chlorine-containing condensate.

12. Process as claimed in claim 1, which comprises effecting the alkali metal chloride electrolysis according to the membrane cell process.

13. Process as claimed in claim 12, which comprises further depressurizing the brine into a vacuum vessel, after it has left the stripping column, condensing the resulting vapors by cooling and adding the condensate being free from chlorine and salt and resulting from the condensation of the vapors of the vacuum vessel to the catholyte of the membrane cell.

14. Process as claimed in claim 12, which comprises choosing the pressure in the anode space and the cathode space of the electrolytic cell such that the pressure difference is 5 bars at a maximum.

15. Process as claimed in claim 12, which comprises maintaining a higher pressure in the cathode space than in the anode space and pressing the membrane on the anode.

16. Process as claimed in claim 15, which comprises using an anode of expanded metal.

17. Process as claimed in claim 3 or 9, which comprises using the heat generated in the condensation of the steam or the vapors for the evaporation of the catholyte.

18. Process for the dechlorination of the anolyte of the alkali metal chloride electrolysis by a decrease of pressure, which comprises effecting the electrolysis under a pressure of at least 8 bars in the anode space, separating the producting leaving the anode space of the electrolytic cell (anolyte and resulting gases) mechanically by means of a separator, depressurizing the separated anolyte with a temperature below the boiling point of the anolyte at atmospheric pressure into a stripping column to a pressure between atmospheric pressure and 2 bars, treating in the stripping column the anolyte in the countercurrent with steam, until it reaches boiling point, and separating the anolyte freed from chlorine by the pressure release and the steam treatment from the gaseous phase having been formed.

* * * * *